United States Patent [19]

Kikugawa

[11] 3,988,884

[45] Nov. 2, 1976

[54] METHOD OF MAKING A WIRE ROPE

[76] Inventor: Shigeharu Kikugawa, No. 781, Sawa, Kaizuka, Osaka, Japan

[22] Filed: Oct. 10, 1974

[21] Appl. No.: 513,638

[52] U.S. Cl. ..... 57/162; 57/149

[51] Int. Cl.[2] ..... D07B 7/14

[58] Field of Search ..... 57/139, 144, 145, 149, 57/153, 161, 162, 164, 166, 160; 29/191.6, 193

[56] References Cited

UNITED STATES PATENTS

| | | | |
|---|---|---|---|
| 198,083 | 12/1877 | Crandal | 57/153 |
| 2,067,405 | 1/1937 | Mayne | 57/149 X |
| 2,605,201 | 7/1952 | Howe | 57/145 X |
| 3,240,570 | 3/1966 | Grimes et al. | 29/191.6 |
| 3,395,530 | 8/1968 | Campbell | 57/164 X |
| 3,601,970 | 8/1971 | Roberts et al. | 57/153 |
| 3,778,994 | 12/1973 | Humphries | 57/149 |
| 3,834,149 | 9/1974 | Nisbet | 57/145 |

*Primary Examiner*—Donald E. Watkins
*Attorney, Agent, or Firm*—George B. Oujevolk

[57] ABSTRACT

A method of making wire rope which when finished comprises a plural number of wires assembled in a twisted state. Each of said wires is first electroplated with zinc and thence diametrically adjusted as to its length by the application of a cold working thereto. Then the wire rope is further electroplated with tin thereby obtaining corrosion-proof and solderable property besides becoming resistant against friction and the like due to its surface lubrication in comparison with conventional wire ropes.

1 Claim, 3 Drawing Figures

METHOD OF MAKING A WIRE ROPE

The present invention relates to a wire rope and in particular a wire rope electroplated doubly with zinc and tin thereby obtaining corrosion-proof, solderable property besides durability against friction and the like to a greater extent than wire ropes of the prior art.

Conventional wire ropes usually having only a tin coating are defective commonly in that they are vulnerable to corrosion-causing factors and, in addition, the thermal-plating method applied thereto further causing them to be less durable against friction and the like.

It is generally known that, when applied to wires, electroplating is more advantageous than thermal-plating, i.e. the electroplating is free from causing a change of quality on the wires, provides a coating of even thickness all over and it is possible to obtain a desired thickness of the coating. Also electroplating causes no bad effect on wires' plasticity as compared to thermal plating.

Conventionally, however, electroplating from a technical view point has not been used for wires which constitute a wire rope. The rope-composing wires are diametrically adjusted, prior being formed into a wire rope, by means of an extension process thereby becoming so thin as to be unsuitable for the electroplating.

This invention, on the other hand, makes it possible to electroplate wires with zinc in the first stage prior to their thickness adjustment for forming a rope, the constituted wire rope is then further electroplated with tin in the second stage.

A main object of this invention is to avoid the defects of conventional wire ropes by providing a wire rope with two electroplatings thereby providing corrosion-proof property besides durability against friction and the like.

This object can be established by the improvement, combination and operation of every part constituting this invention, the preferred embodiment of which will be illustrated in relation with the annexed drawing as below.

Figure 1:
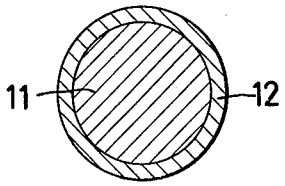
FIG. 1 is a magnified sectional view of a wire electroplated with zinc.

In FIG. 1, numeral 11 designates a wire electroplated with zinc, said zinc forming a film 12 of a predetermined thickness.

Figure 2:
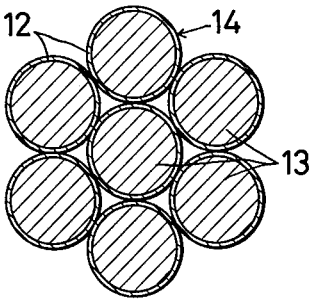
FIG. 2 is a sectional view of a wire rope consisting of the above-mentioned wires.
Figure 3:
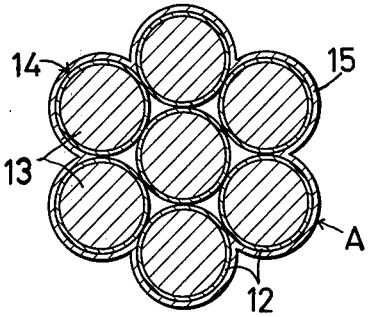
FIG. 3 is a sectional view of the above wire rope further electroplated with tin.

In FIGS. 2 and 3, numeral 13 designates a wire extended from the above wire 11 so as to be diametrically sized as desired. In this process, cold working is applied so as not to cause any damage on film 12.

As described hereinbefore, this invention makes it possible to electroplate wires prior to their diametrical adjustment, i.e. their extension under a cold working, said extension after application of the electroplating acting to prevent said wires from development of unevenness, ruggedness and the like on the surface thereof.

Numeral 14 in the drawing designates a wire rope consisting of a plural number of the foregoing zinc-electroplated wires 13 twisted together. Any number of wires can be used for forming a wire rope, needless to say, regardless of the seven wires shown in the annexed drawing. Also a combination of wires varying in thickness can be used for making up a rope.

In this invention, the wire rope 14 usually is formed by twisting a plural number of wires with each other as is done conventionally, but otherwise said wires are put into a twisted combination around a rope or a wire as the core thereby forming a wire rope 14, or forming a magnified wire rope by means of bringing a plurality of wire ropes 14 into a twisted unification.

In FIG. 3, numeral 15 designates the electroplated tin film covering the wire rope 14 at the outer surface thereof, said wire rope 14 with the application of said tin electroplating becomes a complete wire rope as designated by A in the FIG. 3.

The advantageous points of the wire rope in this invention have been proven in a series of tests conducted on a length of said wire rope in comparison with two lengths of conventional wire ropes by means of spraying salt water thereon, under conditions of: salt water density 5 percent; room temperature 36° C; spray amount 1.2 ml/H; spray pressure 1.0 kg/cm². The test divided in seven stages was conducted continuously for 672 hours but interrupting said test after each stage, the interrupting hours designated by Rest in the Table I totalling to 448 hours. One of the two conventional wire ropes was of thermally plated tin coating and the other being of zinc coating.

The test result is shown in Table I below. The word Rest designates the above-mentioned interrupting periods, the test-result being observed at the end of said "Rest" in each stage.

Table I

| Hours(H) | Items | Wire Rope of This Invention | Conventional Wire Rope Thermally Plated with Tin | Conventional Wire Rope Thermally Plated with Zinc |
|---|---|---|---|---|
| Spray | 8 H | No irregularity seen but salt | Sign of rust development seen 6 hours after start of the | Partial development of zinc white seen. Also |
| Rest | 16 H | layer thereover | spray, the rust getting clearer at the end of this stage | partial color change on the surface |
| Spray | 16 H | Same as the above | Rust development seen on and along the wire-twisted | Extensive development of zinc white. Partial ex- |
| Rest | 32 H | | portions all over thereof | foliation of the coated film seen |
| Spray | 24 H | Same as the above | Development of rust completely thereover. Partial corrosion on the wires-twisted | Exfoliation of film on the greater part thereof. |
| Rest | 48 H | | portions | Partial rust development |
| Spray | 32 H | Same as the above | Test halted | Rust development on the greater part thereof. |
| Rest | 64 H | | | Partial corrosion |
| Spray | 40 H | Same as the above | | Overall corrosion |
| Rest | 80 H | | | |
| Spray | 48 H | No corrosion seen but partial color | | Test halted |

Table I-continued

| Hours(H) | Items | Wire Rope of This Invention | Conventional Wire Rope Thermally Plated with Tin | Conventional Wire Rope Thermally Plated with Zinc |
|---|---|---|---|---|
| Rest | 96 H | change on the surface | | |
| Spray | 56 H | Same as the above | | |
| Rest | 112 H | | | |

This wire rope also has proven in a test to be more durable than conventional wire ropes against friction and the like because of the difference in surface lubricity between the two, the electroplating being advantageous over the thermal plating in this regard, needless to say. The electroplating further affords a property to this wire rope favorable for soldering.

Used in the test were one piece of this invention wire rope and another one piece of conventional wire rope thermally plated with zinc, both ropes being equivalent in the number of twisted wires and also in diametrical size thereof.

In the test conducted under the following conditions, both of the ropes survived through frequencies until cut off as listed in the Table II in the annexed paper.

Test conditions:

| | | |
|---|---|---|
| 1. | Pulley ratio | 9.5 times |
| 2. | Idle pulley diameter | 300 mm |
| 3. | Moving distance | 340 mm |
| 4. | Repeated frequencies | 120 times/min. |
| 5. | Tension (load on the idle pulley) | 9.1 kg |

Table II

| | This Invention Wire Rope | Conventional Wire Rope |
|---|---|---|
| 1 | 51,400 | 40,200 |
| 2 | 51,380 | 39,230 |
| 3 | 51,600 | 40,220 |
| 4 | 51,280 | 40,080 |
| 5 | 51,680 | 40,150 |
| 6 | 51,520 | 39,460 |
| 7 | 51,620 | 40,030 |
| 8 | 51,380 | 40,260 |
| 9 | 51,410 | 40,410 |
| 10 | 51,820 | 40,110 |
| 11 | 51,380 | 40,120 |
| 12 | 51,980 | 40,120 |
| 13 | 52,460 | 40,260 |
| 14 | 51,380 | 39,270 |
| 15 | 51,620 | 40,320 |
| Average | 51,592 | 40,016 |

As described hereinbefore, the wire rope in this invention is advantageous not only in corrosion proof property but also in durability against friction and the like due to the good lubricity at the surface thereof.

What is claimed is:

1. A process of making a wire rope comprising the steps of:

a. electroplating a plurality of wire strands with zinc to a predetermined thickness;

b. extending the strands by cold working to a predetermined diameter;

c. twisting the strands into a wire rope; and, d. electroplating a tin film over the finished rope covering the outer surface of the rope.

* * * * *